US006436882B1

(12) United States Patent
Rizvi

(10) Patent No.: US 6,436,882 B1
(45) Date of Patent: Aug. 20, 2002

(54) FUNCTIONAL FLUIDS

(75) Inventor: Syed Q. A. Rizvi, Milford, CT (US)

(73) Assignee: King Industries, Inc., CT (US)

( * ) Notice: Subject to any disclaimer, the term of this patent is extended or adjusted under 35 U.S.C. 154(b) by 0 days.

(21) Appl. No.: 09/896,041

(22) Filed: Jun. 29, 2001

(51) Int. Cl.[7] ..... C10M 135/10

(52) U.S. Cl. ..... 508/390; 508/403; 508/410; 508/418

(58) Field of Search ..... 508/390, 418, 508/403, 410

(56) References Cited

U.S. PATENT DOCUMENTS

| | | | | |
|---|---|---|---|---|
| 2,764,548 A | | 9/1956 | King et al. | 252/33 |
| 3,853,810 A | | 12/1974 | Plank | 260/45.75 |
| 3,959,399 A | | 5/1976 | Bridwell et al. | 260/671 C |
| 4,018,865 A | | 4/1977 | Gallacher | 423/24 |
| 4,079,012 A | * | 3/1978 | Bosniak | 252/402 |
| 4,175,049 A | | 11/1979 | Knollmueller | 252/78.3 |
| 4,194,905 A | | 3/1980 | Gallacher | 75/101 BE |
| 4,238,343 A | | 12/1980 | Pellegrini, Jr. | 585/24 |
| 4,254,087 A | | 3/1981 | Grinstead | 423/24 |
| 4,255,395 A | | 3/1981 | Gallacher et al. | 423/24 |
| 4,269,761 A | | 5/1981 | Suhoza | 260/45.7 S |
| 4,360,514 A | | 11/1982 | Buck | 424/56 |
| 4,382,872 A | | 5/1983 | Grinstead | 252/189 |
| 4,419,252 A | | 12/1983 | Shim | 252/32.7 E |
| 4,460,564 A | | 7/1984 | Sipos | 424/52 |
| 4,592,783 A | | 6/1986 | Dressler et al. | 106/14.05 |
| 4,593,137 A | | 6/1986 | Fraenkel et al. | 585/467 |
| 4,604,491 A | | 8/1986 | Dressler et al. | 585/26 |
| 4,714,794 A | | 12/1987 | Yoshida et al. | 585/26 |
| 4,749,518 A | | 6/1988 | Davis, Jr. et al. | 252/627 |
| 4,897,209 A | | 1/1990 | Law et al. | 252/32.7 E |
| 4,912,277 A | | 3/1990 | Aufdembrink et al. | 583/455 |
| 4,962,256 A | | 10/1990 | Le et al. | 585/467 |
| 5,001,295 A | | 3/1991 | Angevine et al. | 585/467 |
| 5,019,670 A | | 5/1991 | Le et al. | 585/467 |
| 5,023,016 A | | 6/1991 | Gallacher et al. | 252/389.52 |
| 5,034,563 A | | 7/1991 | Ashjian et al. | 585/455 |
| 5,043,508 A | | 8/1991 | Aufdembrink et al. | 585/455 |
| 5,107,049 A | | 4/1992 | Le et al. | 585/467 |
| 5,112,506 A | * | 5/1992 | Marsh et al. | 508/390 |
| 5,132,478 A | | 7/1992 | Ho et al. | 585/467 |
| 5,137,648 A | * | 8/1992 | Marsh et al. | 508/390 |
| 5,144,082 A | | 9/1992 | Forbus et al. | 565/785 |
| 5,157,187 A | | 10/1992 | Le et al. | 585/481 |
| 5,171,915 A | | 12/1992 | Forbus et al. | 585/455 |
| 5,177,284 A | | 1/1993 | Le et al. | 585/455 |
| 5,191,134 A | | 3/1993 | Le | 585/446 |
| 5,191,135 A | | 3/1993 | Dwyer et al. | 585/455 |
| 5,210,350 A | | 5/1993 | Solofo et al. | 585/323 |
| 5,236,610 A | | 8/1993 | Perez et al. | 252/56 S |
| 5,254,274 A | | 10/1993 | Ho et al. | 252/45 |
| 5,342,532 A | | 8/1994 | Takei et al. | 252/45 |
| 5,393,823 A | | 2/1995 | Konno et al. | 524/507 |
| 5,401,896 A | | 3/1995 | Kuehl et al. | 585/455 |
| 5,457,254 A | | 10/1995 | Ardito et al. | 585/455 |
| 5,531,911 A | * | 7/1996 | Adams et al. | 508/408 |
| 5,602,086 A | | 2/1997 | Le et al. | 508/591 |
| 5,629,463 A | | 5/1997 | Ardito et al. | 585/455 |
| 5,639,825 A | | 6/1997 | Nanbu et al. | 525/100 |
| 5,744,670 A | | 4/1998 | Motoyuki et al. | 585/320 |
| 5,767,045 A | | 6/1998 | Ryan | 508/287 |
| 5,844,064 A | | 12/1998 | Motoyuki et al. | 528/272 |
| 6,005,055 A | | 12/1999 | Dammert et al. | 525/326.5 |
| 6,043,391 A | | 3/2000 | Berger et al. | 562/41 |
| 6,046,144 A | * | 4/2000 | Karol et al. | 508/408 |
| 6,071,864 A | | 6/2000 | Hsi Ho et al. | 508/591 |
| 6,108,086 A | | 8/2000 | Michal et al. | 356/350 |
| 6,121,501 A | | 9/2000 | Motoyuki et al. | 585/323 |
| 6,224,642 B1 | | 5/2001 | Daly et al. | 44/434 |

FOREIGN PATENT DOCUMENTS

| | | | |
|---|---|---|---|
| EP | 0 400 857 B1 | 9/1993 | C07C/2/66 |
| EP | 0 496 486 B1 | 3/1994 | C10M/111/04 |
| WO | WO 91/15443 | 10/1991 | C07C/2/68 |
| WO | WO 98/02510 | 1/1998 | C10M/169/04 |

* cited by examiner

*Primary Examiner*—Jacqueline V. Howard
(74) *Attorney, Agent, or Firm*—William A. Simons; Wiggin & Dana

(57) ABSTRACT

A functional fluid composition comprising a mixture of:

(a) at least one functional fluid base stock; and (b) an additive package comprising at least one derivative of a mono-, di-, or poly-alkylated naphthalenesulfonic acid selected from the group consisting of:

(i) neutral metal salts of said mono-, di-, and poly-alkylated naphthalenesulfonic acids;

(ii) basic metal salts of said mono-, di-, and poly-alkylated naphthalenesulfonic acids;

(iii) amine salts of said mono-, di-, and poly-alkylated naphthalenesulfonic acids; and (iv) esters of said mono-, di-, and poly-alkylated naphthalenesulfonic acids;

wherein the mono-, di-, and poly-alkylated naphthalenesulfonic acids are represented by formula (I):

(I)

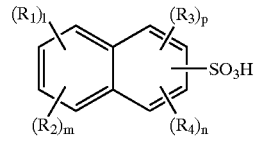

wherein $R_1$, $R_2$, $R_3$ and $R_4$ are individually selected from the group consisting of hydrogen and essentially linear hydrocarbyl groups having about 10 to about 14 carbon atoms; and wherein l, m, n and p are integers from 0 to 4 and the sum of l+m+n+p is at least 1; and wherein $R_1$, $R_2$, $R_3$, or $R_4$ is a hydrogen where either l, m, n, or p is 0.

29 Claims, No Drawings

FUNCTIONAL FLUIDS

BACKGROUND OF THE INVENTION

1. Field of the Invention

The present invention relates to functional fluid compositions that contain selected compounds derived from alkylnaphthalenesulfonic acids. In particular, this invention relates to functional fluid compositions that contain selected salts and esters derived from mono-, di-, and/or poly-alkyl substituted naphthalenesulfonic acids. These sulfonic acid derivatives impart corrosion-inhibiting, rust-inhibiting, friction-modifying, oxidation-inhibiting, and antiwear properties to functional fluids.

2. Brief Description of Art

Various derivatives of alkylated benzenesulfonic and naphthalenesulfonic acid compositions have been used as corrosion inhibitors, rust inhibitors and wear control agents for a wide variety of functional fluids, including lubricants and hydraulic fluids. Such derivatives include neutral metal salts, basic metal salts, and amine salts derived from alkylated benzenesulfonic and naphthalenesulfonic acids.

These derivatives have been prepared by first alkylating benzene, naphthalene or alkylnaphthalene with a suitable alkylating agent in the presence of a catalyst. The most common alkylation method is the Friedel-Crafts method employing alkyl halides, alcohols or olefins. The Friedel-Crafts method for the alkylation of benzene and naphthalene with alkyl halides, alcohols, or olefins to produce the corresponding alkylated products has been extensively described in the literature and reviewed, e.g., by C. C. Price in "Organic Reactions", Volume 3, Chapter 1, pages 1–82, John Wiley & Sons, Inc., 1946. The alkylation reaction, catalyzed by materials such as aluminum chloride, antimony pentachloride, ferric chloride, stannic chloride, zinc chloride, hydrogen fluoride, sulfuric acid, and phosphoric acid, must be carefully controlled to achieve the degree of alkylation required and to control the formation of polyalkylation and rearrangement products (C. C. Price, supra). Rearrangement of the alkyl group can occur during the Friedel-Crafts alkylation reaction, so that one obtains a mixture of linear and branched alkyl-substituted aromatic compounds even when starting alkylating agents are linear. The position of substitution of the alkyl groups on the aromatic ring is dependent on the alkylating agent, reaction conditions, and type of catalyst utilized.

Another known method of alkylating benzene or naphthalene or alkylnaphthalenes to produce a composition substituted with linear alkyl groups is the two step synthesis that includes: (1) Friedel-Crafts acylation of benzene or naphthalene with an acyl halide, such as RCOCl (where R is a linear alkyl group), to form an acylated product, followed by (2) Clemmenson reduction or Wolff-Kirshner reduction of the carbonyl group. These reactions are well known in the literature and are discussed in textbooks, such as that by R. T. Morrison and R. N. Boyd entitled "Organic Chemistry," Third Edition, Chapters 12, 19, and 30, Allyn and Bacon, Inc., 1973.

The preferred commercial method of making polyalkylnaphthalenes has been the alkylation of naphthalene with propylene or butylene trimers or tetramers in the presence of a catalyst. This reaction is described in detail in U.S. Pat. No. 2,764,548 (King and Thielcke). The resulting alkylnaphthalenes have highly branched polypropylene or polybutylene chains ($C_9$, $C_{12}$ or $C_{16}$ in length).

U.S. Pat. Nos. 5,401,896 and 6,071,864 teach the alkylation of naphthalene and alkylnaphthalenes with alkylation agents in the presence of zeolites. These patents do not teach or suggest making of the sulfonic acids or their derivatives from the resulting alkylnaphthalenes.

In the case of known commercial functional fluids that contain alkylated naphthalenesulfonic acid derivatives, the alkyl chains are derived from propylene or butylene trimers or tetramers. While such existing functional fluids are suitable for a wide variety of applications, it has now been discovered that if each of the alkyl chains in these derivatives is essentially linear while being at least 10 carbon atoms ($C_{10}$) in length, significant improvements in corrosion inhibition, demulsibility, and wet filterability may be achieved. Two tests that are commonly used to assess wet filterability are the Wet AFNOR Filtration Test and the Wet Pall Test. The wet tests differ from the dry tests in that the wet tests contain a recommended amount of water. Accordingly, the present invention is based on these discoveries.

BRIEF SUMMARY OF THE INVENTION

Therefore, one aspect of the present invention is directed to a functional fluid composition comprising a mixture of:

(a) at least one functional fluid base component; and (b) an additive package comprising at least one derivative of a mono-, di-, or poly-alkylated naphthalenesulfonic acid selected from the group consisting of:

(i) neutral metal salts of said mono-, di-, and poly-alkylated naphthalenesulfonic acids;

(ii) basic metal salts of said mono-, di-, and poly-alkylated naphthalenesulfonic acids;

(iii) amine salts of said mono-, di-, and poly-alkylated naphthalenesulfonic acids; and (iv) esters of said mono-, di-, and poly-alkylated naphthalenesulfonic acids;

wherein the mono-, di-, and poly-alkylated naphthalenesulfonic acids are represented by formula (I):

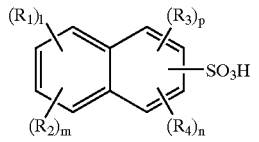

(I)

wherein $R_1$, $R_2$, $R_3$ and $R_4$ are individually selected from the group consisting of hydrogen or essentially linear hydrocarbyl groups having about 10 to about 14 carbon atoms; and wherein l, m, n and p are integers from 0 to 4 and the sum of l+m+n+p is at least 1; and wherein $R_1$, $R_2$, $R_3$, or $R_4$, is a hydrogen where either l, m, n or p is 0.

Another aspect of the present invention is directed to a hydraulic fluid which is dispersant-free and contains (a) at least one hydraulic fluid base component; and (b) an additive package as defined above.

A preferred aspect of the present invention is directed to a functional fluid composition comprising a mixture of:

(a) at least one functional fluid base component; and (b) an additive package comprising at least one neutral or basic calcium salt of a mono-, di-, or poly-alkylated naphthalenesulfonic acid as defined above, preferably in an effective rust-inhibiting amount.

The incorporation of these particular alkylnaphthalenesulfonic acid derived compositions into the functional fluid formulations of the present invention provides several advantages over the commercially known functional fluids described above. Specifically, the functional fluids of the present invention have excellent rust- and corrosion-inhibiting properties and improved demulsibility, while maintaining the better hydrolytic stability, thermal stability, and antiwear performance of the functional fluids described above. In addition, these additives impart oxidation-inhibiting, friction-modifying, and antiwear properties to certain types of functional fluids. Specifically for hydraulic fluids, the present sulfonic acid derivatives have the advantages of providing a combination of good demulsibility, rust performance and the wet filterability performance, as assessed by the AFNOR and the Pall Tests. Passing this combination of tests is a common problem with the corresponding branched-chain type alkylarylsulfonic acid derivatives as well as with linear-chain type alkyl benzene sulfonic acid derivatives. Many suppliers of commercial hydraulic fluids add dispersants to hydraulic fluid formulations to overcome wet filtration problems. See U.S. Pat. No. 5,767,045, which provides an example of using this type of strategy. The present invention has the special advantage of not requiring the use of the additional dispersant to achieve good wet AFNOR performance for certain hydraulic fluid formulations.

DETAILED DESCRIPTION OF THE INVENTION

Throughout this specification and claims, all parts and percentages are by weight, temperatures are in degrees Celsius, and pressures are at or near atmospheric unless otherwise clearly indicated.

As used in this specification and in the appended claims, the terms "hydrocarbyl" and "hydrocarbylene" denote a group having a carbon atom directly attached to the naphthalene ring or amine and ester portion of the molecule and having a hydrocarbon or predominantly hydrocarbon character within the context of this invention. Such groups include the following:

(1) Hydrocarbon groups; that is, aliphatic (e.g., alkyl or alkenyl), alicyclic (e.g., cycloalkyl or cycloalkenyl), and the like, as well as cyclic groups wherein the ring is completed through another portion of the molecule (that is, any two indicated substituents may together form a ring). Such groups are known to those skilled in the art. Examples include methyl, ethyl, octyl, decyl, octadecyl, cyclohexyl, and the like.

(2) Substituted hydrocarbon groups; that is, groups containing non-hydrocarbon substituents which, in the context of this invention, do not alter the predominantly hydrocarbon character of the group. Those skilled in the art will be aware of the suitable substituents. Examples include halo, hydroxy, alkoxy, and the like.

(3) Pendent groups, that is, the groups such as alkoxy, carboxy and hydroxyalkyl.

(4) Hetero groups, that is, groups which, while predominantly hydrocarbon in character within the context of this invention, contain atoms other than carbon in a chain or ring otherwise composed of carbon atoms. Suitable hetero atoms will be apparent to those skilled in the art and include, for example, nitrogen and oxygen. Suitable hetero groups include, for example, amino, alkoxy, and carboxyl.

In general, no more that about three substituents or hetero atoms, and preferably no more than one, will be present for every 10 carbon atoms in the hydrocarbyl group.

Terms such as "alkyl", "alkylene", and the like have meanings analogous to the above with respect to hydrocarbyl and hydrocarbylene.

The term "hydrocarbon-based" also has the same meaning and can be used interchangeably with the term hydrocarbyl when referring to molecular groups having a carbon atom attached directly to the polar group.

The term "dispersant-free" as used in the present specification and claims is defined to mean that no other compounds whose primary function is to disperse ordinarily oil-insoluble materials in the lubricant are added to the functional fluids of the present invention. Such materials are known to those skilled in the art.

The term "poly" when referring to alkylated naphthalenesulfonic acid compounds in the present specification and claims is defined to mean that either three or four hydrocarbyl groups are attached to the naphthalene ring.

The term "functional fluids" as used in the present specification and claims includes any and all functional fluid compositions that (1) are generally known in the art; and (2) contain an additive package that includes at least one derivative of a mono-, di-, or poly-alkylated naphthalenesulfonic acid as noted above. Suitable functional fluid applications include greases, lubricating oils, hydraulic fluids, metalworking fluids, and heat-transfer fluids.

The preferred functional fluids to which the present invention is directed include hydraulic fluids.

The term "hydraulic fluid" as used in the present specification and claims includes any and all compositions that (1) are generally known in the art and (2) contain an additive package that includes at least one derivative of the mono-, di-, or poly-alkylated naphthalenesulfonic acid as noted above. These preferred hydraulic fluid compositions are useful in any system wherein a mechanical effort is converted to generate pressure at a first location, then the pressure is converted to a second mechanical effort at the second location. Thus, the hydraulic systems contemplated, where the present invention is useful include hydraulic brake systems, hydraulic steering mechanisms, hydraulic transmissions, hydraulic jacks and hydraulic lifts. Included among these are the hydraulic systems used in heavy equipment and transportation vehicles, including highway and construction equipment, railways, airplanes and aquatic vehicles. Also included are special or custom fluid-requiring systems, such as high pressure or temperature gradient systems, including those employed in arctic environments as well as those found in aerospace vehicles and the like.

The functional fluids of the present invention have two critical components. The first component is a base fluid [Component (a) noted above]. The base fluid component may be petroleum, synthetic, or biological in origin. Petroleum-derived base fluids (also sometimes called mineral oils) are the base fluids that are most often used in developing functional fluids. Synthetic base stocks, the second largest group in terms of use, are usually made from petroleum-derived organic chemicals. These synthetic base stocks are generally used for extremely demanding applications where petroleum-derived base fluids can not be used. Semi-synthetic base fluids are base stocks that are blended from synthetic base stocks and mineral oils. Such base stocks are used to benefit from the superior operating properties of the synthetic stocks, but at a lower cost. Base stocks of biological origin include vegetable oils and animal fats. These are often used to formulate environmentally compatible functional fluids. The present invention is useful in functional fluids that employ any of these types of base stocks. That is, the present invention is useful for all categories of base stocks, as defined by the American Petroleum Institute's (API) Base Oil Classification System, viz. API Group I to Group V oils.

Besides the base fluid, functional fluids always contain additives. Additives improve the properties of functional fluids by either enhancing the desirable properties already present in the base fluids or by adding new properties to the base fluids. Commonly used additives include dispersants, detergents, friction modifiers, antiwear agents, extreme pressure agents, oxidation inhibitors, rust and corrosion inhibitors, emulsifiers, demulsifiers, pour point depressants, foam inhibitors, and viscosity modifiers.

For the present invention, at least one selected salt or ester derivative is present in the additive package as a rust-inhibitor, a corrosion-inhibitor, an oxidation inhibitor, a friction modifier, or an antiwear agent, depending on its structure. More particularly, these selected salt or ester derivatives are one or more of the derivatives of a mono-, di-, or poly-alkylated naphthalenesulfonic acid as noted above [Component (b)(i) to Component (b)(iv)]. These derivatives are made from mono-, di-, or poly-alkylated naphthalene that is converted into the corresponding sulfonic acid which is then transformed into the desired derivative. In terms of the use of the present invention, other classes of additives may or may not be present in this additive package.

The alkylated naphthalenesulfonic acid derivatives can have from 1 to 4 hydrocarbyl groups attached to the naphthalene ring, wherein the combined sum of the carbons in the 1 to 4 hydrocarbyl groups is at least 10 carbon atoms and preferably from 10 to 56. The naphthalene precursors to these derivatives are prepared by methods that form "essentially linear" hydrocarbyl chains. Suitable methods involve the alkylation of naphthalene with a $C_{10}$ to $C_{14}$ alpha olefin, a $C_{10}$ to $C_{14}$ primary alcohol, or a $C_{10}$ to $C_{14}$ primary alkyl halide (i.e. they contain a double bond, a hydroxyl group, or a halogen group at the end of a linear chain). Mixtures of $C_{10}$, $C_{12}$, and $C_{14}$ homologues of these alkylating agents also can be used. These alkylation reactions are known to those skilled in the art and are generally conducted in the presence of a catalyst. Suitable catalysts include any of the Lewis acid or super acid catalysts known in the art. Suitable Lewis acids include aluminum chloride, boron trifluoride, iron trichloride, tin tetrachloride, zinc dichloride, and antimony pentafluoride. Acidic clays, silica, or alumina also are suitable. See for example U.S. Pat. Nos. 4,604,491 and 4,714,794. Suitable super acid catalysts include trifluoromethanesulfonic acid, hydrofluoric acid or trifluoromethylbenzenesulfonic acid. Other suitable catalysts include acidic zeolite catalysts, such as Zeolite Beta, Zeolite Y, ZSM-5, ZSM-35 and USY. In one embodiment of the present invention, it is preferred to alkylate naphthalene with an alpha olefin using aluminum chloride as the catalyst. The use of a co-catalyst such as nitromethane, nitrobenzene, or a low molecular weight alcohol to promote the reaction also is suitable. See, for example, U.S. Pat. No. 2,764,548 to King et al. In another embodiment, it is preferred to alkylate naphthalene with an alpha olefin using trifluoromethanesulfonic acid as the catalyst. It is important to note that the resulting alkylnaphthalene composition may contain varying amounts of dimer-, trimer-, or tetramer-alkylated naphthalene, which can result from polymerization of the olefin prior to alkylation.

In still another embodiment, compounds other than naphthalene may be alkylated to provide suitable alkylated naphthalenes. In particular, the addition of longer chain alkyl groups, e.g. about $C_{10}$ to about $C_{14}$, to short chain alkylated naphthalenes, (e.g. methyl-naphthalene, ethylnaphthalene, propylnaphthalene, butylnaphthalene) may be suitable.

Most preferred, the substrate of the present derivatives (b)(i) to (b)(iv) may be prepared by reacting naphthalene with an alpha olefin in the presence of aluminum chloride as a catalyst. The alpha olefin to naphthalene ratio may be between 1 to 4 moles of alpha olefin to each mole of naphthalene.

A critical feature of the present invention is that the hydrocarbyl chains on the naphthalene rings are all "essentially linear". This means that branching is minimized or non-existent and the hydrocarbyl chains are predominantly linear. Hydrocarbyl chains prepared from $C_3$ or $C_4$ trimers or tetramers are explicitly excluded from this definition of "essentially linear." The preferred essentially linear hydrocarbyl chains each are predominantly 10 to 28 carbon atoms in length and more preferably predominantly 12 or 24 carbon atoms in length (ie. $C_{12}$.monomers or dimers). The present invention is a composition which can contain $C_{10-14}$ monoalkyl-, $C_{10-14}$ dialkyl-, $C_{10-14}$ polyalkyl-naphthalene derivatives in various ratios.

The resulting alkylnaphthalene precursors can then be sulfonated by means known in the art. Sulfonation typically is conducted by reacting the alkylated naphthalene with a sulfonating agent, such as fuming sulfuric acid (oleum), sulfur trioxide, or chlorosulfonic acid. Examples of procedures for sulfonation are found in Jerry March, *Advanced Organic Chemistry, Reactions, Mechanisms and Structure,* $4^{th}$ edition, John Wiley and Sons, p. 528, 1992. Typically, about 1 mole of sulfur trioxide is added preferably to each mole of alkylnaphthalene composition in a hydrocarbon solvent. The molecular weight of the alkylnaphthalene composition used for this reaction is the average molecular weight of all the alkylnaphthalene components present in the alkylate. Once the sulfonation reaction is complete, the sulfuric acid is removed and the hydrocarbon layer is washed with water to remove water-soluble byproducts.

The four classes of derivatives listed below can be prepared from the mono-, di-, and/or poly-alkylated naphthalenesulfonic acids using well known procedures.

The preferred neutral salts of the mono-, di-, and/or poly-alkylated naphthalenesulfonic acids are represented by formula (II):

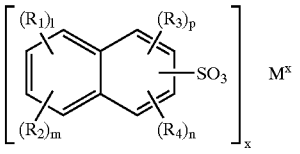

(II)

wherein $R_1$, $R_2$, $R_3$, $R_4$, l, m, n and p are the same as defined above; M is a metal selected from the group consisting of alkali metal, alkaline earth metal, transition metal, Group IVb metal and Group Vb metal; and x is the valence of the metal, M. When either l, m, n, or p is 0, then a hydrogen is the substituent on the ring structure as the respective R group.

If M is an alkali metal, it is preferred to use lithium, sodium, potassium, or mixtures thereof If M is an alkaline earth metal, it is preferred to use magnesium, calcium, strontium, barium, or mixtures thereof.

The term "transition metal or element", as used in the present specification and claims, is defined as the metal in the periodic table that has partly filled d or f orbitals. Transition elements are listed in the middle of the long form of the Modem Periodic Table of Elements. Depending upon the supplier of the Periodic Table, transition elements are either listed as Group IIIa to Group VIIa, Group Ib, and Group IIb elements or Group 3 to Group 12 elements, or both. The version in Advanced Inorganic Chemistry by F. A.

Cotton, Third Edition, John Wiley Publishers (1972) uses Roman numeral designations and the Learning Laboratories version (1996 copyright) uses Arabic numeral designations to list these elements. The preferred transition metals are zinc, copper, cerium, molybdenum, or mixtures thereof.

The term "Group IVb metal" as used in the present specification and claims is defined as elements that contain 4 electrons in their valence shell. Again, depending upon the date of the Periodic Table, they are called either Group IVb elements or Group 14 elements, as described in the previous paragraph. The preferred metals belonging to this group are tin, lead, or mixtures thereof.

The term "Group Vb metal", as used in the present specification and claims, refers to elements that contain 5 electrons in their valence shell. The same as above, depending upon the date of the Periodic Table, they are either Group Vb elements or Group 15 elements, as described in the previous paragraph. The preferred metals belonging to this group are bismuth, antimony, or mixtures thereof In order to avoid confusion, Roman numeral group designations will be used in the rest of this patent document.

Besides these classes of neutral salts of mono-, di-, and/or poly-alkylated naphthalenesulfonic acids, it may be desirable in some instances to use mixtures of metals from these classes. For example, it may be desirable to use mixed metal sulfonates in some functional fluids. That is, the salts that are derived from the reaction of alkylnaphthalenesulfonic acids with mixtures of calcium and zinc bases.

The above-noted preferred neutral salts are prepared by reacting the mono-, di-, and/or poly-alkylated naphthalenesulfonic acid precursors with a metallic compound capable of forming the neutral salts. Many metal bases are known in the art to be suitable for this purpose and include metal oxides, hydroxides, and carbonates. The sulfonic acids are either reacted with a stoichiometric amount of base to form neutral salts, also known as soaps in lubricant additive industry, or with excess base to form basic salts or overbased materials, commonly referred to as detergents. In the latter case, carbon dioxide is often used to convert the base into its carbonate form. While many bases form salts with sulfonic acids, alkali metal and alkaline metal salts are often preferred as lubricant additives. Alkali metal salts employ metal hydroxides, such as sodium hydroxide and potassium hydroxide, as the bases. For alkaline earth metal salts, oxide and hydroxide bases are preferred for magnesium, calcium and barium salts. However, calcium salts derived by the use of calcium carbonate also are known. While for neutral salt formation, contact between organic acid and inorganic base is normally not a problem; for basic (overbased) salt formation, one needs to use promoters that enhance this contact. A wide variety of materials are used for this purpose and include water; ammonium hydroxide; low molecular weight alcohols, such as methanol, isopropanol, and isobutanol; and low molecular weight alkylphenols. To make the neutral salts used in the functional fluids of the present invention, the acid is reacted with a stoichiometric amount of the base and the resulting water and a solvent, if present in the starting sulfonic acid, are removed. The product may be adjusted with diluent oil preferably to provide a metal content between 1.0 to 15 percent. These acids also may be converted to make basic or overbased detergents. While generally the terms basic and overbased imply materials that contain a reserve base, in the context of the present invention this requirement is not necessary. What is necessary is that such materials contain a higher metal content than that in neutral salts. That is, they have a metal ratio greater than 1 (see Chapter 3 on detergents/dispersants by C. C. Colyer and W. C. Gergel, published in "Chemistry and Technology of Lubricants," R. Mortier and S. T. Orszulik, VCH Publishers 1992). Metal carbonate and metal borate overbased detergents of the present invention are preferred to have an approximate base number of less than about 500.

The preferred basic metal salts of the mono-, di-, and/or poly-alkylated naphthalenesulfonic acids are represented by the formulae (III), (IV), and (V):

(III)

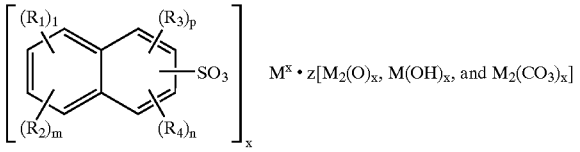

(IV)

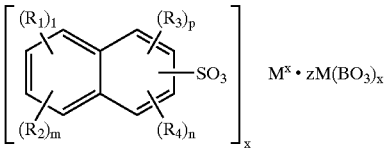

(V)

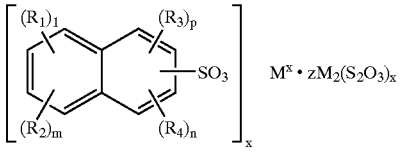

wherein $R_1$, $R_2$, $R_3$, $R_4$, l, m, n and p are as defined above for formula (I) and M is a metal ion selected from the group consisting of alkali metal, alkaline earth metal, transition metal, Group IVb metal, and Group Vb metal; x is the valence of M and z is from 0.1 to 50.

When basic or overbased metal salts are employed in the functional fluids of the present invention, the same alkali metals, alkaline earth metals, transition metals, Group IVb metals and Group Vb metals preferred for neutral salts also are preferred for these basic metal salts. In some instances, it may be preferred to use mixtures of the same class or different classes of basic metal salts.

The above-noted preferred basic metal salts are prepared by reacting or otherwise combining the mono-, di-, or poly-alkylated naphthalenesulfonic acid precursor with a metallic compound selected from the classes $M_2(O)_x$, $M(OH)_x$, or $M_2(CO_3)_x$. and combinations thereof. Metal carbonate overbasing typically requires the use of carbon dioxide as a reactant. Metal borate overbasing, on the other hand, requires the use of boric acid. Metal sulfate and metal thiosulfate overbased materials are made by reacting the metal carbonate overbased material with sulfur dioxide and subsequent oxidation with oxygen and sulfur. See U.S. Pat. Nos. 5,484,542; 5,064,545; and 4,539,126 for procedures describing the preparation of these salts.

The carbonate-containing basic (overbased) metal salts can be made either from the neutral salt or directly from the alkylnaphthalenesulfonic acids. The first method involves taking a neutral salt, suspending it in an organic solvent, such as toluene, adding a base and blowing the reaction with carbon dioxide. The second method involves first making the neutral salt in situ by reacting the arylsulfonic acid with the metal base, adding excess base and then blowing the reaction with carbon dioxide. The latter method is preferred, since it does not involve isolation of the neutral salt prior to overbasing. The metal borate overbased products can be made either directly from the sulfonic acid, as described in U.S. Pat. No. 6,090,757; or by reacting the carbonate overbased product with a boron source, preferably boric acid. This is described in U.S. Pat. No. 5,484,542. This patent also teaches the methodology to make sulfite detergents by first displacing the $CO_2$ of the carbonate overbased detergents with $SO_2$. The sulfite overbased materials are then converted into sulfate and thiosulfate overbased products via reaction with an oxygen or sulfur source, respectively.

The preferred amine salts of the mono-, di-, and/or poly-alkylated naphthalenesulfonic acids are either ammonium or amine salts as represented by formulae (VI) and (VII):

(VI)

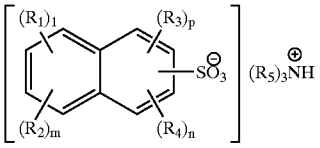

(VII)

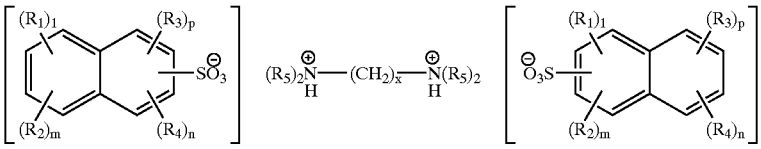

wherein $R_1$, $R_2$, $R_3$, $R_4$, l, m, n and p are the same as defined above and $R_5$ is individually a hydrogen atom or a hydrocarbyl group containing from 1 to 25 carbon atoms, and x is from 2 to 5.

The above-noted amine salts are made preferably by reacting or otherwise combining the mono-, di-, and/or poly-alkylated naphthalenesulfonic acid precursors with an amine compound selected from primary, secondary or tertiary amines, as well as ammonia. The preferred amine derivatives are those derived from primary monoamines, such as t-alkylamine (Primene 81R, Rohm and Haas supplier), oleylamine, and tallowalkylamine (Akzo Nobel supplier); secondary amines, such as dicocoalkylamine and ditallowalkylamine (Akzo Nobel supplier); diamines, such as N-coco-1,3-diaminopropane and N-oleyl-1,3-diaminopropane (Akzo Nobel supplier); etheramines, such as isododecyloxypropylamine and N-isodecyloxypropyl-1,3-diaminopropane (supplied by Tomah Products, Inc.), and some of Jeffamine M and Jeffamine D products (Huntsman Corporation supplier); and ethoxylated amines, such as ethoxylated cocoalkylamine and ethoxylated N-tallow-1,3-diaminopropane (Azko Nobel's Ethomeen C/12 and Ethoduomeen T/13).

The amine salts of the present invention are made by reacting the sulfonic acid or acids with the appropriate amine. Usually, the amine is added to the acid with temperature control because the reaction is exothermic. The temperature of the reaction typically is maintained around 80° C. or below to minimize acid reversal to the free alkylate.

The preferred esters of the mono-, di-, and/or poly-alkylated naphthalenesulfonic acids are represented by formula (VIII):

(VIII)

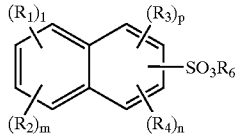

wherein $R_1$, $R_2$, $R_3$, $R_4$, l, m, n and p are the same as defined above and $R_6$ is a hydrocarbyl group containing from 2 to 18 carbon atoms.

The above-noted esters are preferably made by reacting or otherwise combining the mono-, di-, and/or poly-alkylated naphthalenesulfonic acids precursor with an unsaturated compound, such as acrylic acid, methacrylic acid, and derivatives thereof, styrene, vinyl alcohol and vinyl acetate or a reactive organic compound, such as an aldehyde, ketone, or a cyclic oxide. The sulfonate esters derived from alkyl acrylates, alkyl methacrylates, and olefin epoxides are amongst those that are most preferred. Generally, these compounds are reacted with the alkylnaphthalenesulfonic acids under anhydrous conditions to form the esters of the present invention. Because typically such a reaction is exothermic, temperature control is usually employed.

The amount of the functional fluid base component (a) should be preferably at least about 50% by weight of the total functional fluid composition; more preferably, at least about 75% by weight of the total functional fluid. The preferred amount of the sulfonic acid derivatives should be at least 0.0005% by weight of the total functional fluid. Preferably, it is less than about 25% by weight, more preferably, less than about 10% by weight of the total functional fluid. In a rust preventive coating formulations, the amount can be as high as 25%.

Optionally, the functional fluid composition may include other additives. Optional additives may contain other performance additives known in the art, which include but are not limited to dispersants, detergents, antioxidants, antiwear additives, extreme pressure additives, rust and corrosion inhibitors, copper metal passivators, viscosity index improvers, friction modifiers and the like. The preferred additives in the formulation depend upon the nature of the functional fluid. For combustion engine lubricants and automatic transmission fluids, the preferred additive system primarily comprises dispersant, detergent, antioxidant, antiwear agent, viscosity improver, friction modifier, pour point depressant, foam inhibitor, and rust and corrosion inhibitor. Gear lubricants and hydraulic fluids contain an additive system that includes all other additives listed under engine oils, but is usually free of a dispersant. Industrial hydraulic fluids are also devoid of a friction modifier. Metalworking fluids typically contain detergent, extreme pressure/antiwear agent, antioxidant, corrosion inhibitor/metal deactivator, friction modifier, and foam inhibitor additives. Greases contain a thickener and an additive package comprising an antiwear/extreme pressure additive, an antioxidant, and a corrosion inhibitor. The amount of each additive differs in each of these applications.

The compositions of the present invention may be employed in many applications, including transmission fluids, gear oils, hydraulic fluids, metalworking fluids, and greases. These compositions also are useful in rust-inhibiting formulations, such as rust preventives, where a liquid or semisolid formulation containing an effective amount of at least one rust-inhibiting composition, such as that of the present invention, is applied to metal parts. The evaporation and/or oxidation of the organic components of the formulation results in a coating that protects the metal parts against rust.

In the case of the lubricating oils, an important feature of the invention is the ability of the additive to improve the performance characteristics of a finished lubricating oil, whether derived from a mineral base stock, synthetic base stock, mixtures of these two base stocks, or a grease in which any of the aforementioned base stocks are employed as a vehicle. In general, the mineral base stocks; paraffinic, naphthenic, and mixtures thereof; employed to formulate a lubricating oil or used as the grease vehicle can be of any suitable lubricating viscosity range, as for example, from about 10 cSt to about 2000 cSt at 40° C., and preferably from about 25 to about 70 cSt at 100° C. These oils may have viscosity indexes ranging from 70 to 120 or higher. Viscosity indexes from about 80 to about 120 are preferred. The average molecular weight of these oils can range from about 250 to about 800. Specific examples of oils of lubricating viscosity are described in U.S. Pat. No. 4,326,972 and European Patent Publication 107,282, both herein incorporated by reference of their disclosures relating to lubricating oils. A basic, brief description of lubricant oils appears in an article by D. V. Brock, "Lubricating Base Oils", Lubrication Engineering, volume 43, pages 184–185, March, 1987. The article is incorporated herein by reference for its disclosures relating to lubricating oils. A description of oils of lubricating viscosity occurs in U.S. Pat. No. 4,582,618 (column 2, line 37 through column 3, line 63 inclusive), herein incorporated by reference for its disclosure to oils of lubricating viscosity.

Where the lubricant is employed as a grease, the lubricating oil is generally used in an amount sufficient to balance the total grease composition, after accounting for the desired quantity of the thickening agent and other additive components included in the grease formulation. A wide variety of materials can be employed as thickening or gelling agents. These can include any of the conventional metal salts or soaps, such as calcium, or lithium stearates or hydroxystearates, which are dispersed in the lubricating vehicle in grease-forming quantities in an amount to impart the desired consistency to the resulting grease composition. Other thickening agents that can be employed in the grease formulation comprise the non-soap thickeners, such as surface-modified clays and silicas, aryl ureas, calcium complexes and similar materials. In general, grease thickeners can be employed which do not melt and dissolve when used at the required temperature within a particular environment; however, in all other respects, any material which is normally employed for thickening or gelling hydrocarbon fluids for forming a grease can be used in preparing the aforementioned improved grease in accordance with the present invention.

In instances where synthetic oils, or synthetic oils employed as the vehicle for the grease are desired in preference to mineral oils, or in preference to mixtures of mineral and synthetic oils, various synthetic oils may be utilized successfully. Typical synthetic oil vehicles include polyisobutylenes, polybutenes, hydrogenated polydecenes, polypropylene glycol, polyethylene glycol, trimethylolpropane esters, neopentyl alcohol and pentaerythritol esters, di(2-ethylhexyl) sebacate, di(2-ethylhexyl) adipate, dibutyl phthalate, fluorocarbons, silicate esters, silanes, esters of phosphorus-containing acids, liquid ureas, ferrocene derivatives, hydrogenated synthetic oils, chain-type polyphenyls, siloxanes and silicones (polysiloxanes), and alkyl-substituted diphenyl ethers typified by a butyl-substituted bis (p-phenoxy phenyl) ether, and phenoxy phenylethers.

It is to be understood that the compositions contemplated herein also can contain other materials. For example, other corrosion inhibitors, extreme pressure agents, viscosity index improvers, co-antioxidants, antiwear agents, and the like can be used. These include, but are not limited to, phenates, sulfonates, succinimides, zinc dialkyl or diaryl dithiophosphates, and the like. These materials do not detract from the value of the compositions of this invention.

The hydraulic fluids of the present invention have particularly advantageous characteristics that make them better than previously commercially available functional hydraulic fluids that incorporated the branched alkylarylsulfonic acids of the prior art. For example, in hydraulic fluids in particular, these characteristics include better rust inhibition and better demulsibility, without adversely affecting the wet AFNOR filtration performance of the finished fluid.

The present invention is further described in detail by means of the following Examples and Comparisons.

EXAMPLES

Synthesis of the Alkylated Naphthalenes

Example I

Naphthalene (64 parts) was mixed with aluminum chloride catalyst (3.34 parts). The mixture was brought to ~70–80° C. and 1-dodecene (168 parts) was added at a rate to maintain the temperature. The reaction was exothermic, hence external cooling was employed. After the addition of the olefin was complete, the reaction mixture was held at 80° C. for 1 hour. Then, the catalyst was quenched by adding water and the product filtered to yield about 200 parts of alkylate. This product was stripped under high vacuum to remove unreacted starting materials.

Example II

The procedure employed was the same as described in Example I, except that 128 parts of naphthalene, 1.67 parts of aluminum chloride, and 306 parts of 1-dodecene were used.

Example III

The procedure employed was the same as described in Example I, except that 128 parts of naphthalene, 1.67 parts of aluminum chloride, and 269 parts of 1-dodecene were used.

Example IV

The procedure employed was the same as described in Example I, except that 82 parts of naphthalene were reacted with 200 parts of an olefin mixture comprising 96 parts 1-decene, 96 parts 1-dodecene, 8 parts 1-tetradecene, and 1.67 parts of aluminum chloride.

Synthesis of the Alkylnaphthalenesulfonic Acids

Example V

Alkylnaphthalene compositions described above under Examples I to IV were sulfonated using the amount of oleum that delivered 0.8–1.2 moles of sulfur trioxide per equivalent of alkylnaphthalene. The method involved adding oleum to a solution of the alkylate at moderate temperatures (about 20° C. to about 30° C.) in a hydrocarbon solvent, such as hexane or heptane. Methods to sulfonate aromatic hydrocarbons are well documented in the art. See for example, "Direct Sulfonation of Aromatic Hydrocarbons and Their Halogen Derivatives," by C. M. Sutter and A. W. Weston, Published in Organic Reactions Volume III (1946). The resulting sulfonic acids were purified by conventional methods, such as washing with water. Alternatively, thermal treatment with stirring or nitrogen bubbling (see, for example, the method described in French Patent No. 93 11709) could be employed instead of water washing. The sulfonic acids were prepared from alkylate compositions that contained from 20% polyalkylnaphthalenes to 100% polyalkyl naphthalenes. The rest of the composition comprised monoalkylnaphthalenes and dialkylnaphthalenes in various ratios.

Synthesis of Neutral and Basic Metal Sulfonates

Example VI

An alkylnaphthalenesulfonic acid composition of Example V was blended with a hydrocarbon solvent, such as heptane or toluene and diluent oil so as to provide approximately 50–70% solution. Diluent oil is a material well known to makers of hydraulic fluid formulations. After introducing a water-alcohol promoter system, a slight stoichiometric excess of a base selected from either $Ca(OH)_2$, or $CaCO_3$, was added. Alternatively, CaO, MgO, or $Ba(OH)_2$ could be used to prepare these neutral salts. The reaction was held at 90° C., the mixture was brought to reflux and the resulting water was azeotroped off. When all of the water was collected, the volatile components from the reaction mixture were removed using vacuum distillation. The dark color product was filtered. The metal content in these neutral salts ranges from 1.5 to 2.5% of calcium.

Example VII

Diluent oil and an isoamyl alcohol—isobutyl alcohol-water promoter system were added to the toluene solution of alkylnaphthalenesulfonic acid from Example V. This was followed by the addition of either sodium or calcium hydroxide in an amount that is in excess of that necessary for the neutral salt formation. The mixture was held for 2 hours at 75° C. and then volatiles were removed. At this stage, toluene and an isoamyl alcohol—isobutyl alcohol mixture (50/50 by weight) were added. Carbon dioxide was introduced at a rate of about 0.5 SCF/hr to the vigorously stirred mixture of these components at about 100° C. When carbon dioxide uptake stopped at about 1 to about 2 hours, the mixture was heated to 150° C. to remove the volatile components. More diluent oil was added to adjust the sulfonate level to 30–40% and the metal carbonate overbased metal sulfonate was filtered using diatomaceous earth. The product had a total base number of 100–200 and a metal ratio of between 5 and 10, depending upon the metal.

Example VIII

Metal (e.g. calcium, magnesium and zinc) borate overbased products from alkylnaphthalenesulfonic acids of Example V can be prepared according to methods described in the U.S. Pat. No. 6,090,757. The sulfonate level in such products would be 30–40% and the metal content would be about 2.0–3.0%.

Example IX

Alkylnaphthalensulfonic acids of Example V could be converted into metal (e.g. calcium, magnesium and zinc) sulfate and thiosulfate overbased products according to methods described in the U.S. Pat. No. 5,484,542. The sulfonate level in such products would be 30–40% and the metal ratio would be about 5.0 to 10.0.

Synthesis of Amine Sulfonates

Example X

An alkylnaphthalenesulfonic acid from Example V (112 parts; 0.0835 eq) and diluent oil (50 parts) were charged to a reactor. Oleylamine (Armeen O) (23.8 parts; 0.0881 eq) was added drop wise to the stirring reaction mixture while keeping the temperature around 75° C. There was an exotherm and external cooling was necessary to maintain the temperature. When the addition of amine was complete, the volatiles (primarily heptane) were removed at 100° C. by first using atmospheric distillation and then vacuum to obtain the product (123 parts) as an amber liquid. It's measured base number was 1.0.

Example XI

An alkylnaphthalenesulfonic acid from Example V (268 parts; 0.2 eq) and diluent oil (100 parts) were charged to a reactor. Di-2-ethylhexylamine (51.6 parts; 0.214 eq) was added drop wise to the stirring reaction mixture while keeping the temperature around 75° C. A small exotherm was observed. When the addition of amine was complete, the volatiles were removed from the reaction as described in Example X to yield the product (272 parts) as an amber liquid with a measured base number of 2.5.

Synthesis of Sulfonate Esters

Example XII

The alkylnaphthalenesulfonic acid from Example V could be reacted with an unsaturated compound, such as styrene or alkyl acrylate in a sulfonic acid to olefin ratio of 1.00 to 1.02. The product is obtained as a dark-colored fluid.

Example XIII

The alkylnaphthalenesulfonic acid from Example V could be reacted with an olefin epoxide in a sulfonic acid to epoxide ratio of 1.00 to 1.02. During the addition of the epoxide to the sulfonic acid, the reaction temperature is maintained around 75° C. The reaction product is a dark-colored fluid.

Finished Functional Fluids

The data presented below, exemplified by industrial hydraulic fluid formulations, emphasize the advantages of the present invention over other commercial products. The tests were performed using a commercial additive system for HF-0 quality hydraulic fluids ('Additive Package I") that was devoid of the rust and corrosion inhibitors for each test. This additive system package and the calcium salts of the present invention described under Example VI or other alternatives ("Additives 1–7") were added to either an API Group I, Group II, or Group III base oil ("Base Fluid A, B, or C") at the recommended level. The combined Additive 1–7/Additive Package I contained about 70 to 80% by weight zinc dialkyl dithiophosphate; about 2 to 5% by weight liquid dimercaptothiadiazole or tolyltriazole derivative; about 14 to 20% of an oxidation inhibitors package; and about 7 to 11% by weight of one of the Additives 1–7. This combined Additive 1–7/Additive Package I mixture was then combined with one of the base fluids A, B, or C in an amount that delivered 10.6 ppm calcium to the finished fluid. The resultant formulations were tested to see if they met the Rust Test (ASTM D 665), the Demulsibility Test (ASTM D 1401), and AFNOR Wet Filtration Test. Additionally, they were tested to see if they had any change in performance in Cincinnati Milacron Test (ASTM D 2070) and Hydrolytic Stability Test (ASTM D 2619).

ASTM D 665 is a standard test method for evaluating rust-preventing characteristics of inhibited oil in the presence of water. The method involves stirring a steel rod in a sample of oil at 60° C. that contains 3% water by weight. The test is run in duplicate and has a duration of 24 hours. The test has two versions. The A version uses distilled water and the B version uses synthetic sea water. The B version is more severe than the A version. At the end of the test, the spindles are examined for signs of rusting or the degree of rusting. Rust-free steel rods are given a pass rating.

ASTM D 1401 is a standard test method to measure the demulsibility characteristics of oils. According to this method, 40 ml of test oil and 40 ml of water are mechanically stirred in a 100 ml graduated cylinder for 5 minutes. At this time, stirring is stopped and the time needed to separate the oil/water emulsion is observed at 5 minute intervals. The time needed to achieve 3 ml or less emulsion is reported. The test is run at 54° C. if the oil has a viscosity of less than 90 cSt at 40° C. The test is run at 82° C. if the oil has a viscosity of greater than 90 cSt at 40° C.

The AFNOR Filtration Test is designed specifically for hydraulic fluids. A sample of 320 ml oil is stored in a 70° C. oven for 2 hours. It is taken out of the oven, mixed at 1500 rpm for 5 minutes, and transferred back into the oven for additional 70-hour storage. The sample is then placed in a dark cabinet, which is at ambient temperature. After 24 hours, the sample is pressure filtered at 14.5 psi using a fine filter. The time to filter several specified volumes are noted and converted into filterability index. The value of the index between 1 and 2 is considered a pass, although a value of closer to one is generally preferred. In the Wet AFNOR procedure, the test oil sample is contaminated with 0.2 ml of water. The Wet AFNOR Test procedure is more severe than the Dry AFNOR Test procedure. Cincinnati Milacron Test (ASTM D 2070) is a thermal stability test. According to this test method, clean, polished, pre-weighed copper and steel rods are placed in 200 ml of test oil and the oil is stored at 135° C. for 168 hours. After this time, the copper and steel rods are removed and a number of analyses are performed. For HF-0 oils, sludge of less than 100 mg/100 ml and copper weight loss of less than 10 mg are desired.

Hydrolytic Stability Test is an ASTM Standard (ASTM D 2619), which is used to measure the hydrolytic stability of hydraulic fluids and turbine oils. A sample of 75 g of test oil, 25 ml of distilled water, and a pre-weighed copper strip are sealed in a pressure-type beverage bottle. The bottle is rotated end to end at 5 rpm in a 93° C. oven for 48 hours. The copper strip is removed and oil and water layers are separated. A number of analyses are recommended in the Standard but the two most important ones are the total acidity of the water layer and the copper weight loss. The preferred values for these two parameters for HF-0 qualified hydraulic fluids are water acidity (total acid number) of 4.0 and a copper loss of 0.2 mg/cm$^2$.

Salt Spray Test is an ASTM Test Method (ASTM B 117) which is an accelerated method to determine rust prevention characteristics of a coating. The test procedure involves storing coated panels at 35° C. in a cabinet that has an atmosphere of salt containing vapors. The number of hours to failure is the time for the onset of rust. The greater the number of hours, the more effective the additive system.

Cleveland Condensing Test is an ASTM Test Method (ASTM D 4585) which is used to test water resistance of coatings using controlled condensation. The coated test panels make up the roof and the walls of the test chamber. These panels are exposed to water vapor generated by heating a pan of water at the bottom of the test chamber. The number of hours to failure is the time for the onset of rust. Again, the greater the number of hours, the more effective the additive system.

TABLE 1

| | Performance Data | | | | | | |
|---|---|---|---|---|---|---|---|
| Additive | 1 | 2 | 3 | 4 | 5 | 6 | 7 |
| Additive Package | I | I | I | I | I | I | I |
| Base Fluid A Exxon — Group I Base Oil | | | | | | | |
| D 655B | Fail | Pass | Pass | Pass | Pass | Pass | Pass |
| D 1401 | Pass | Pass | Pass | Pass | Pass | Pass | Pass |
| Wet AFNOR Filterability | Fail | Fail | Fail | Pass | Pass | Pass | Pass |
| Base Fluid B Chevron — Group II Base Oil | | | | | | | |
| D 665B | Fail | Pass | Pass | Pass | Pass | Pass | Pass |
| D 1401 | Pass | Pass | Pass | Pass | Pass | Pass | Pass |
| Wet AFNOR Filterability | Pass | Fail | Pass | Pass | Pass | Pass | Pass |
| Base Fluid C Petro Canada — Group III Base Oil | | | | | | | |
| D 665B | Fail | Pass | Pass | Pass | — | — | Pass |
| D 1401 | Pass | Pass | Pass | Pass | — | — | Pass |
| Wet AFNOR Filterability | Fail | Fail | Fail | Pass | — | — | Pass |

Footnotes to the Table 1

1. Additive 1: Commercial Calcium dialkylbenzenesulfonate from Pilot Chermical-C5000.
2. Additive 2: Commercial Calcium dialkylbenzenesulfonate from Rhein Chemie-RC4220.
3. Additive 3: Lab-prepared $C_{12}$ dialkylbenzene-derived neutral calcium sulfonate.
4. Additive 4: Neutral calcium salts of the present invention containing 33% dialkyl ($C_{10}$ to $C_{14}$) naphthalene sulfonate and 67% polyalkyl ($C_{10}$ to $C_{14}$) naphthalene sulfonate derivatives prepared generally according to Example VI.
5. Additive 5: Neutral calcium salts of the present invention containing 100% polyalkyl ($C_{10}$ to $C_{14}$) naphthalene sulfonate derivative prepared generally according to Example VI.
6. Additive 6: Neutral calcium salt of the present invention containing 80% dialkylnaphthalene sulfonate and 20% polyalkyl ($C_{10}$ to $C_{14}$) naphthalene sulfonate derivatives prepared generally according to Example VI.

TABLE 1-continued

| Additive | Performance Data 1 | 2 | 3 | 4 | 5 | 6 | 7 |
|---|---|---|---|---|---|---|---|

7. Additive 7: Neutral calcium salt of the present invention containing 3% monoalkyl, 55% dialkyl ($C_{10}$ to $C_{14}$) naphthalene sulfonate and 42% polyalkyl ($C_{10}$ to $C_{14}$) naphthalene sulfonate derivatives prepared generally according to Example VI.
8. Additive Package I is a hydraulic fluid additive package as defined above.
9. Exxon-Group I Base Oil was Exxon Americas Core 600/150 (34%/66%).
10. Chevron-Group II Base Oil was 220R Neutral.
11. Petro Canada-Group III Base Oil was VHVI8.

All of the materials of the present invention also passed the Cincinnati Milacron Test (ASTM D 2070) and the Hydrolytic Stability Test (ASTM D 2619). The compositions of the present inventions have solid across-the-board performance in all of the required tests.

The data in a Rust Preventive formulation are provided in Table II below. Additives 1 and 2 are commercial products that are used as rust preventives and Additive 4 is from the present invention. Higher ratings in the two listed tests are more desirable.

TABLE 2

Performance in a Rust Preventive Formulation
Formulation: 20% Additive and 80% Base fluid

| Additive | None | Additive 1 | Additive 2 | Additive 4 |
|---|---|---|---|---|
| Salt Spray Test (hrs to failure) | 1 | 6 | 6 | 6 |
| Cleveland Condensing Test (hrs to failure) | 8–24 | 126 | 126 | 126 |

Footnotes to the Table 2
1. Additive 1: Commercial Calcium dialkylbenzenesulfonate from Pilot Chermical-C5000.
2. Additive 2: Commercial Calcium dialkylbenzenesulfonate from RheinChemie-RC4220.
4. Additive 4: Neutral calcium salts of the present invention containing 33% dialkyl ($C_{10}$ to $C_{14}$) naphthalene sulfonate and 67% polyalkyl ($C_{10}$ to $C_{14}$) naphthalene sulfonate derivatives prepared generally according to Example VI.

While the invention has been described above with reference to specific embodiments thereof, it is apparent that many changes, modifications, and variations can be made without departing from the inventive concept disclosed herein. Accordingly, it is intended to embrace all such changes, modifications and variations that fall within the spirit and broad scope of the appended claims. All patent applications, patents and other publications cited herein are incorporated by reference in their entirety.

What is claimed is:

1. A functional fluid composition comprising a mixture of:

(a) at least one functional fluid base component; and (b) an additive package comprising at least one derivative of a mono-, di-, or poly-alkylated naphthalenesulfonic acid selected from the group consisting of:

(i) neutral metal salts of said mono-, di-, and poly-alkylated naphthalenesulfonic acids;

(ii) basic metal salts of said mono-, di-, and poly-alkylated naphthalenesulfonic acids;

(iii) amine salts of said mono-, di-, and poly-alkylated naphthalenesulfonic acids; and (iv) esters of said mono-, di-, and poly-alkylated naphthalenesulfonic acids;

wherein the mono-, di-, and poly-alkylated naphthalenesulfonic acids are represented by formula (I):

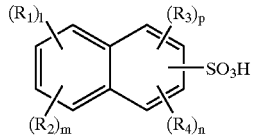

(I)

wherein $R_1$, $R_2$, $R_3$ and $R_4$ are individually selected from the group consisting of hydrogen or essentially linear hydrocarbyl groups having about 10 to about 14 carbon atoms; and wherein l, m, n and p are integers from 0 to 4 and the sum of l+m+n+p is at least 1; and wherein $R_1$, $R_2$, $R_3$, or $R_4$ is a hydrogen where either l, m, n, or p is 0; said concentration of the at least one derivative is sufficient so that the functional fluid composition has effective rust- and corrosion-inhibiting properties, wet filterability performance and effective demulsibility.

2. The functional fluid composition of claim 1 wherein at least one derivative of the alkylated naphthalenesulfonic acid composition is the neutral metal salt component (b)(i) and is represented by the formula (II):

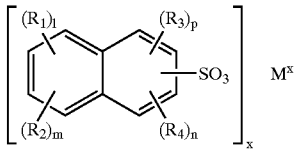

(II)

wherein $R_1$, $R_2$, $R_3$ and $R_4$, l, m, n and p are as defined above; M is a metal selected from the group consisting of alkali metals, alkaline earth metals, transition metals, Group IVb metals, and Group Vb metals; and x is the valence of M.

3. The functional fluid composition of claim 2 wherein M in formula (II) is an alkali metal selected from the group consisting of lithium, sodium, potassium, and mixtures thereof.

4. The functional fluid composition of claim 2 wherein M in formula (II) is an alkaline earth metal selected from the group consisting of magnesium, calcium, strontium, barium and mixtures thereof.

5. The functional fluid composition of claim 2 wherein M in formula (II) is a transition metal selected from the group consisting of zinc, copper, cerium, molybdenum, and mixtures thereof.

6. The functional fluid composition of claim 2 wherein M in formula (II) is a Group IVb metal and is selected from the group consisting of tin, lead, and mixtures thereof.

7. The functional fluid composition of claim 2 wherein M in formula (II) is a Group Vb metal selected from the group consisting of bismuth, antimony, and mixtures thereof.

8. The functional fluid composition of claim 2 wherein M in formula (II) is a mixture of at least two metals selected from the classes of alkali metals, alkaline earth metals, transition metals, Group IVb metals and Group Vb metals.

9. The functional fluid composition of claim 1 wherein at least one derivative of the alkylated naphthalenesulfonic acid composition is the overbased metal salt component (b)(ii) and is represented by formulae (III), (IV), and (V), and mixtures thereof:

(III)

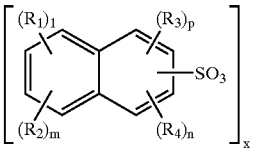

$M^x \cdot z[M_2(O)_x, M(OH)_x, \text{ and } M_2(CO_3)_x]$ (IV)

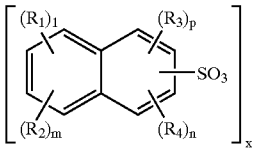

$M^x \cdot zM(BO_3)_x$

-continued (V)

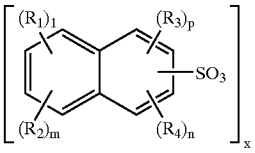

$M^x \cdot zM_2(S_2O_3)_x$ wherein $R_1$, $R_2$, $R_3$ and $R_4$, l, m, n and p are as defined in formula (I); M is a metal selected from the group consisting of alkali metals, alkaline earth metals, transition metals, Group IVb metals, and Group Vb metals; x is the valence of M; and z is 0.1 to 50.

10. The functional fluid composition of claim 9 wherein M in formulae (III), (IV), and (V) is an alkali metal selected from the group consisting of sodium, potassium, lithium, and mixtures thereof.

11. The functional fluid composition of claim 9 wherein M in formulae (III), (IV), and (V) is an alkaline earth metal selected from the group consisting of calcium, magnesium, strontium, barium, and mixtures thereof.

12. The functional fluid composition of claim 9 wherein M in formulae (III), (IV), and (V) is a transition metal selected from the group consisting of zinc, copper, cerium, molybdenum, and mixtures thereof.

13. The functional fluid composition of claim 9 wherein M in formulae (III), (IV), and (V) is a Group IVb metal and is selected from the group consisting of tin, lead, and mixtures thereof.

14. The functional fluid composition of claim 9 wherein in formulae (III), (IV), and (V) is a Group Vb metal selected from the group consisting of bismuth, antimony, and mixtures thereof.

15. The functional fluid composition of claim 9 wherein formulae (III), (IV), and (V) is a mixture of at least two metals selected from the classes of alkali metals, alkaline earth metals, transition metals, Group IVb metals and Group Vb metals.

16. The functional fluid composition of claim 1 wherein at least one derivative of the alkylated naphthalenesulfonic acid composition is the amine salt component (b)(iii).

17. The functional fluid composition of claim 16 wherein the amine salt component (b)(iii) is at least one ammonium or organic amine salt of formulae (VI) and (VII);

(VI)

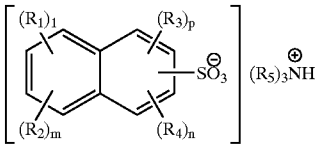

(VII)

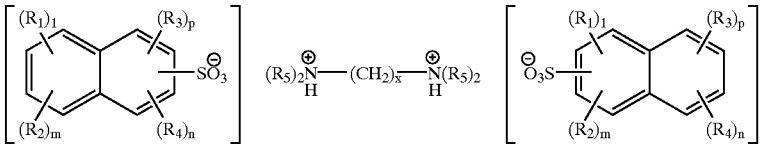

wherein $R_1$, $R_2$, $R_3$ and $R_4$, l, m, n and p are as defined in Formula (I); each $R_5$ is individually selected from a hydrogen atom or a hydrocarbyl group consisting of from 1 to 25 carbon atoms; and x is from 2 to 5.

18. The functional fluid composition of claim 17 wherein the amine salt is derived from a hydrocarbylamine containing up to 80 carbon atoms.

19. The functional fluid composition of claim 1 wherein at least one derivative of the alkylated naphthalenesulfonic acid composition is the ester component (b)(iv).

20. The functional fluid composition of claim 19 wherein the ester component (b)(iv) is at least one compound represented by formula (VIII):

(VIII)

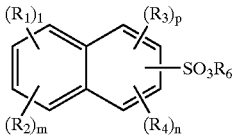

wherein $R_1$, $R_2$, $R_3$ and $R_4$, l, m, n and p are as defined in formula (I) and $R_6$ is a hydrocarbyl group consisting of from 2 to 18 carbon atoms.

21. The functional fluid composition of claim 20 wherein the ester is derived from the reaction of the sulfonic acids with a hydroxy precursor or an unsaturated compound.

22. The functional fluid composition of claim 1 wherein each essentially linear alkyl group predominantly contains 10 to 14 carbon atoms.

23. The functional fluid composition of claim 1 wherein each essentially linear alkyl group predominantly contains 12 carbon atoms.

24. The composition of claim 1 wherein the mono-, di-, and/or poly-alkylated naphthalenesulfonic acids of Formula (I) are derived from either a linear $C_{10}$ to $C_{14}$ alpha olefin alkylating agent, a $C_{10}$ to $C_{14}$ primary alcohol alkylating agent, or a $C_{10}$ to $C_{14}$ primary alkyl halide alkylating agent.

25. The composition of claim 1 wherein the combined sum of carbons in $R_1$, $R_2$, $R_3$ and $R_4$ is from 10 to 56.

26. A functional fluid composition comprising a mixture of:

(a) at least one functional fluid base stock; and (b) an additive package comprising of at least one neutral or basic calcium salt of alkylated naphthalenesulfonic acid composition as defined in claim 1.

27. The functional fluid composition of claim 1 wherein component (a) is at least about 50% by weight of the functional fluid composition and component (b) is at least about 0.0005% by weight of the functional fluid composition.

28. The functional fluid composition of claim 27 wherein component (b) is less than about 25% by weight of the functional fluid composition.

29. A dispersant-free hydraulic fluid composition comprising a mixture of:

(a) at least one hydraulic fluid base stock; and (b) an additive package comprising at least one alkylated naphthalenesulfonic acid composition as defined in claim 1.

* * * * *